United States Patent [19]

Novelli et al.

[11] Patent Number: 4,867,228

[45] Date of Patent: Sep. 19, 1989

[54] ADDITIVE FOR GREEN MOULDING SANDS

[75] Inventors: Giovanni Novelli; Athos Rinaldi, both of Leghorn; Andrea Rossi, Pisa, all of Italy

[73] Assignee: Industria Chimica Carlo Laviosa S.p.A, Leghorn, Italy

[21] Appl. No.: 166,823

[22] Filed: Mar. 4, 1988

[30] Foreign Application Priority Data

Mar. 4, 1987 [IT] Italy ..... 9336 A/87

[51] Int. Cl.[4] ..... B22C 1/18

[52] U.S. Cl. ..... 164/525; 164/528; 106/38.51; 106/38.9

[58] Field of Search ..... 164/520, 522, 523, 525, 164/528; 106/38.2, 38.51, 38.9

[56] References Cited

U.S. PATENT DOCUMENTS

| | | | |
|---|---|---|---|
| 4,194,918 | 3/1980 | George et al. | 106/38.51 |
| 4,203,771 | 5/1980 | Matsui | 106/38.51 |
| 4,504,314 | 3/1985 | Barker et al. | 106/38.51 |
| 4,711,669 | 12/1987 | Paul et al. | 106/38.51 |

FOREIGN PATENT DOCUMENTS

| | | | |
|---|---|---|---|
| 631431 | 11/1961 | Canada | 106/38.51 |
| 1217555 | 5/1966 | Fed. Rep. of Germany . | |
| 2348771 | 11/1977 | France . | |
| 1214308 | 2/1986 | U.S.S.R. | 164/528 |
| 770561 | 3/1957 | United Kingdom | 106/38.51 |
| 1007360 | 10/1965 | United Kingdom . | |

OTHER PUBLICATIONS

Patent Abstracts of Japan, vol. 9, No. 191 (M402)[1914], JP-A-60-56440.

Chemical Abstracts, vol. 106, No. 18, May 4, 1987, p. 225.

Patent Abstracts of Japan, vol. 10, No. 191 (M495) [2247], JP-A-61-37345.

*Primary Examiner*—Richard K. Seidel

*Attorney, Agent, or Firm*—Browdy and Neimark

[57] ABSTRACT

An additive for green moulding sands for use in foundry industry comprising a "stabilized" and polyhydroxylated carbohydrate, in particular as aqueous solution, and preferably consisting of a monosaccharidic and/or oligosaccharidic derivatives where any of the aldehydic and ketonic functions have been selectively reduced or oxidated. The additive improves the flowability and plasticity of the moulding said with a reduced moisture demand and a better surface finishing of the castings.

16 Claims, No Drawings

ADDITIVE FOR GREEN MOULDING SANDS

DESCRIPTION

1. Field of the Invention

The present invention relates to an additive for green moulding sands.

2. Background art

As known in foundry industry, green moulding sands used for making castings of cast iron, non-ferrous alloys and steel are generally constituted by a refractory framework, in particular siliceous sand, agglomerated with clay as a binder. Bentonite is especially used with advantage as binding clay. Green moulding sands also contain water and suitable additives according to the particular use of the mould, for example carbonaceous additives for moulds used for the production of cast-iron castings.

Generally, the moisture required of a moulding sand is in the range of 35–45% with respect to the content of clay binder taking also into account the presence of other substances, i.e., for instance, carbonaceous additives in moulds for producing cast-iron castings. Since the content of clay binder in these moulding sands is approximately 10%, the moisture required relative to the weight of the moulding sand is in the range of 3.5–4.5%. Such moisture demand, indispensable to provide a sufficient flowability and plasticity of the moulding sand, is undesirable relative to the formation of a satisfactory surface finishing, because it reduces the possibility of using minute sand that is the most suitable for obtaining defectless castings with a very good surface finishing. In fact it is known that the surface defects caused, during the founding process, by the expansion of the sand due to the quartz expansion(the transition from alpha- to beta-quartz is already started at 550° C.), occur in particular at the condensation zones where the moisture content is high. Also it is known that, when the total moisture content of the sand is about 1%, the condensation zones do not form and therefore surface defects due to the expansion of the quartz constituting the refractory framework of the mould do not occur. On the other hand, a so low moisture content is actually considered unacceptable for a green moulding sand, due to the poor flowability and plasticity that would make it very difficult to produce moulds.

It is therefore desirable to work with a moulding sand having a moisture content as low as possible and as close as possible to the optimum value of 1% so as to limit the formation of condensation zones and allow the use of minute sands without incurring in the defects due to expansion problems.

SUMMARY OF THE INVENTION

The object of the present invention is to provide an additive for green moulding sands suitable for imparting satisfactory properties of flowability and plasticity to them, while maintaining the moisture content at a low value, in particular in the range of 2–3%.

The additive for green moulding sands according, to the invention is a "stabilized" carbohydrate derived from monosaccharides, oligosaccharides and mixtures thereof. By the term "stabilized" carbohydrate used herein we include highly hydroxylated derivatives where any of the aldehydic and ketonic functions present in the original compound have been selectively reduced, oxidated or reacted with urea or derivatives thereof.

To the purposes of the present invention the following reduced monosaccharidic derivates are particularly preferred: pentitols (such as xilitol), hexitols (such as mannitol, sorbitol, galattol, etc.), mixtures of pentitols and hexitols, hydrolyzed starch containing high percentage of pentitols and hexitols, and in general by-products of industrial processes (glucose syrups, molasses, whey, invert sugar, partially invert sugar, oxidized starch syrups, starch esters, starch carboxylated ethers) suitably stabilized, all of them containing notable percentage (at least 5%) of reduced monosaccharidic derivatives. Furthermore the use of gluconic acid, glucaric acid, alkaline gluconates, mixtures thereof and substances containing these compounds have proven particularly effective for the same purposes, as well as the use of polyvinyl alcohols.

The above mentioned compounds used as additives according to the invention are able to act as wetting agents with respect to the clay binder in such a measure that the corresponding moulding sands, containing the polyhydroxylated compounds as mentioned above, withstand to the drying over a longer period of time. This is due to the excellent hygroscopic and plasticizing properties of these compounds, whereby the low moisture content of the moulding sand is maintained during the processing period without risk of evaporation. These properties may be correlated to the linear structure of these compounds that allows for a sufficient freedom of the several hydroxylic groups; on the contrary hexoses and pentoses, which these compounds come from, contain an aldehydic group and, being cyclic in structure, the hydroxylic groups are not available.

As a result, the use of the additive according to the invention in a green moulding sand allows for the use of an amount of moisture at least close to the theoretical amount necessary for a bentonite to develop its binding properties, and even allows for the use of a lower amount. This may be explained by the fact that, by the use of the additive according to the invention having at least five hydroxylic groups, and preferably six, all the moisture of the system is involved including the moisture of the bentonite contained as free water, evaporable at 100° C. In this way the moisture demand of a moulding sand containing 10% of bentonite is in the range of 2–2.5%, i.e. just the 20–25% of the total clay binder contained therein.

The use of the additive according to the invention has proven very advantageous in obtaining a better surface finishing of the casting resulting from the use of a moulding sand containing such additive. This is due, first of all, to the low moisture content of the sand and, consequently, to the lower casting roughness caused by steam release during the solidification of the molten metal. In the second place, the above result is due to the possibility of using more minute sands thus further reducing the roughness problems. The moulding sand has a greater plasticity and mouldability so that complex castings can be more easily reproduced.

The additive according to the invention is used in the form of aqueous solution to be incorporated in the moulding sand before the use. In order to be efficiently used to the end of the present invention, the additive solution must have a content of stabilized carbohydrate not lower than 30% and preferably equal to 70%.

In the practice, 0.1 to 6 parts of the additive solution are used per 100 parts of moulding sand on a dry basis, according to the solution concentration and preferably 1.5 to 3.5 parts. In particular, when using a 70% additive solution, the optimum amount of solution to be added is from 15 to 50% of the clay binder, on dry basis, present in the moulding sand.

The use of the additive according to the invention, involving a lower moisture demand, allows for the use of very minute sand (grain size in the ranges of 0.2–0.4 mm, 0.1–0.3 mm and 0.06–0.3 mm), this being important in view of a better surface finishing of the castings.

In order to illustrate how the invention is put into practice, some examples of composition of green moulding sand with the additive of the invention are provided hereunder.

Example 1

Moulding sand with the following composition:

| | |
|---|---|
| Siliceous sand (I.F. 70) | 100 Kg |
| AG-type bentonite | 7 " |
| A-type additive solution | 3 " |
| Mulling time: 2–3' | |

where A-type additive is a 70% aqueous solution of polyols obtained by catalytic hydrogenation of hydrolyzed starch having the following characteristics:

| | |
|---|---|
| Specific weight | 1.285 |
| Dry content | 70% |
| Water content (Karl Fisher) | 30% |
| Total sugar | 6–8% |
| Ash | 0.1% |
| pH 50% solution | 5–7% |
| Specific rotatory power of the solution at 20° C. | from + 16° to + 22° |
| Hoppler viscosity at 20° C. | 200 cps approx |
| Reducing sugar | 0.15% max |

The moisture demand of a sand with the above specified composition is about 1.2%, i.e. about 17–18% with respect to the clay binder. It is to be pointed out that a moulding sand with a composition equal to the above but lacking in the additive of the invention would have required at least 3% moisture to exhibit the same flowability and plasticity.

EXAMPLE 2

A further composition of moulding sand including the additive of the invention is the following:

| | |
|---|---|
| Siliceous sand (I.F. 120) | 100 Kg |
| Bentonite | 15 " |
| A-type additive solution | 4 " |
| Mulling time : 3–4' | |

where the additive solution has the same characteristic of example 1.

In this case the moisture demand of the sand having the above specified composition is about 1.3–1.5%, i.e. about 10% with respect to the amount of the clay binder on dry basis. A moulding sand having the same composition but without the additive of the invention would have required at least 5% moisture to exhibit the same flowability and plasticity.

If the additive of the invention is used in a regenerative-cycle type sand, it can be added 0.07 to 0.2 Kg of a 70% additive solution per 100 Kg of exhaust sand together with 0.2–0.3 Kg of mineral black, while the bentonite addition is the same as used in the absence of additive.

Example 3

Another moulding sand containing the additive according to the invention is the following:

| | |
|---|---|
| Siliceous sand (I.F. 65–70) | 100 Kg |
| A.G. Bentonite | 10 " |
| B-type additive solution | 3–4 " |
| Mulling time: 2–3' | |

wherein the B-type additive is a 50% aqueous solution of sodic salt of acid polyols obtained by oxidation of hydrolyzed starch having the following characteristic:

| | |
|---|---|
| Dry residue | 49.2% |
| pH of solution | 7.0% approx. |
| Specific rotatory power | +12° approx. |
| Reducing sugar | 0.3% max |
| Dry substance solubility | |
| in water | high |
| in ethanol | low |
| in ethylic ether | not soluble |

The total moisture of the sand (including the moisture of the clay binder, which is equal to 10–13%, and the moisture of the sand, which is in the range of 0.1–0.3%) is comprised between 2.2 and 2.9%, i.e. a moisture content in the range of 24 and 32% with respect to the anhydrous clay binder. According to the normal practice the moisture demand of a moulding sand of the type specified in the present example, but lacking in the additive of the invention, is in the range of 4–4.5% with respect to the sand and 50–55% with respect to the anhydrous clay binder. Therefore by using the additive according to the invention the amount of moisture necessary to the system is reduced to one half approximately.

In a regenerative-cycle type sand there can be added 0.07 to 0.2 Kg of B-type additive solution per 100 Kg of exhaust sand, as well as 0.1–0.3 Kg of mineral black, when moulding cast-iron castings, besides the necessary amount of bentonite to restore the green strength of the sand, this amount being in the range of 0.2–0.5 Kg. The moisture of the moulding sand is maintained in the range of 2–2.5% rather than 4–4.5%.

It is obvious that, even in the present description reference has been made to moulding sands containing siliceous sand as refractory material, the additive according to the present invention can be used advantageously also in moulding sands based on olivine, chromite, zircon sand and similar material well known in the foundry industry. It is furthermore obvious that, by suitably changing the percentage of addition according to the different specific weight of these sands, the moulding sands containing the additive according to the invention may contain further additive substances of the conventional type to impart special properties to the moulding sand and/or to the article made with it.

We claim:

1. A green moulding sand composition for formation into a metal casting mould, consisting essentially of siliceous sand, an amount of a clay binder sufficient to effect binding of said sand, an amount sufficient to reduce the quantity of water needed to provide an effective flowability and plasticity to the green moulding sand of a substantially water-soluble stabilized carbohydrate, and an amount sufficient to provide flowability and plasticity of the green mounding sand of water, and said water-soluble stabilized carbohydrate being selected from the group consisting of monosaccharide and oligosaccharide derivatives both in the reduced and oxidated form, mixtures of them and industrial by-products containing said derivatives, wherein the total amount of water in said composition is less than 3% based on the total weight of the green molding sand.

2. A green moulding sand according to claim 1 wherein said monosaccharide derivatives are selected from the group consisting of hexatols, pentitols and mixtuxes thereof.

3. A green moulding sand according to claim 1 wherein said oligosaccharide derivatives are polyols of hydrolyzed starch.

4. A green moulding sand according to claim 1 wherein said oxidated monosaccharide derivatives are acid polyols obtained by oxidation.

5. A green moulding said according to claim 1 wherein said water soluble stabilized carbohydrate is mixed with said water in the form of an aqueous solution at a concentration of said stabilized carbohydrate of at least 30%.

6. A green moulding said according to claim 1 wherein said water soluble stabilized carbohydrate is mixed with said water in the form of an aqueous solution at a concentration of said stabilized carbohydrate of 30% to about 70%.

7. A green moulding sand according to claim 1 wherein said industrial by-products containing said derivatives are selected from the group consisting of glucose syrup, molasses, whey, invert sugar, partially inverted sugar, oxidized starch syrup, starch esters, and starch carboxylated ethers.

8. A green moulding sand according to claim 7 wherein said derivatives are present in said industrial by-products in an amount of at least 5% by weight.

9. A green moulding sand composition according to claim 1 wherein said water soluble stabilized carbohydrate and water are present as an approximately 70% aqueous solution of said carbohydrate, and said carbohydrate solution is present in an mount of 0.1 to 6 parts per 100 parts of siliceous sand on a dry basis.

10. A composition according to claim 9 wherein said aqueous solution of said carbohydrate is present in an amount of 1.5 to 3.5 parts per 100 parts of said siliceous sand.

11. A composition according to claim 1 wherein said siliceous sand is of a small grain size in the range of 0.06–0.4 mm.

12. A green moulding sand composition for formation into a metal casting mould, comprising siliceous sand, an amount of a clay binder sufficient to effect binding of said sand, an amount sufficient to reduce the quantity of water needed to provide an effective flowability and plasticity to the green moulding sand of a substantially water-soluble stabilized carbohydrate, and an amount sufficient to provide flowability and plasticity of the green moulding sand of water, containing at most 2.5% water based on the total weight of the green moulding sand, and said water-soluble stabilized carbohydrate being selected from the group consisting of monosaccharide and oligosaccharide derivatives both in the reduced and oxidated form, mixtures of them and industrial by-products containing said derivatives.

13. A green moulding sand composition for formation into a metal casting mould, comprising siliceous sand, an amount of a clay binder sufficient to effect binding of said sand, an amount sufficient to reduce the quantity of water needed to provide an effective flowability and plasticity to the green moulding sand of a substantially water-soluble stabilized carbohydrate, and an amount sufficient to provide flowability and plasticity of the green moulding sand of water, said amount of water being less than 3% based on the total weight of the green moulding sand, and said water-soluble stabilized carbohydrate being selected from the group consisting of monosaccharide and oligosaccharide derivatives both in the reduced and oxidated form, mixtures of them and industrial by-products containing said derivatives;

wherein said clay is bentonite present in an amount of about 10% by weight of the composition, and the moisture content is 20–25% by weight based on the total clay binder contained therein.

14. A method of producing a green sand mould in a foundry comprising providing a green mounding said composition which comprises siliceous sand, an amount sufficient to effect binding of said sand of a clay binder, an amount sufficient to reduce the quantity of water needed below 3% to provide flowability and plasticity to the green moulding sand of a substantially water-soluble stabilized carbohydrate, and an amount sufficient below 3% to provide flowability and plasticity of the green moulding sand of water, said water-soluble stabilized carbohydrate being selected from the group consisting of monosaccharide and oligosaccharide derivatives both in the reduced and oxidated form, mixtures of them and industrial by-products containing said derivatives, said clay being bentonite present in an amount of about 10% by weight of the composition, the moisture content being 20–25% weight based on the total clay binder contained therein; and shaping said green moulding sand in the desired mould form.

15. A method according to claim 14 wherein said additive and said water are used in the form of an aqueous solution of 30% to about 70% of said carbohydrate, said aqueous solution of said additive being provided in a n amount between 0.1 and 6% based on the dry weight of said siliceous sand.

16. A method according to claim 15 wherein said aqueous solution of said additive is used in an amount between 1.5 and 3.5% based on said siliceous sand.

* * * * *